US009777681B2

(12) United States Patent
Gleason

(10) Patent No.: US 9,777,681 B2
(45) Date of Patent: Oct. 3, 2017

(54) COLD AIR INTAKE CIRCULATING AIR JACKET

(71) Applicant: Mark E Gleason, Farmington Hills, MI (US)

(72) Inventor: Mark E Gleason, Farmington Hills, MI (US)

(73) Assignee: FCA US LLC, Auburn Hills, MI (US)

( * ) Notice: Subject to any disclaimer, the term of this patent is extended or adjusted under 35 U.S.C. 154(b) by 183 days.

(21) Appl. No.: 14/685,860

(22) Filed: Apr. 14, 2015

(65) Prior Publication Data

US 2016/0305378 A1 Oct. 20, 2016

(51) Int. Cl.

| | |
|---|---|
| ***F02M 35/10*** | (2006.01) |
| ***F02M 35/024*** | (2006.01) |
| ***F02M 35/16*** | (2006.01) |
| ***F02M 35/02*** | (2006.01) |

(52) U.S. Cl.

CPC .. *F02M 35/10268* (2013.01); *F02M 35/0201* (2013.01); *F02M 35/161* (2013.01)

(58) Field of Classification Search

CPC ..... F02M 35/20; F02M 35/0201; F02M 35/0204; F02M 35/024; F02M 35/04; F02M 35/042; F02M 35/048; F02M 35/10006; F02M 35/10091; F02M 35/10144; F02M 35/10268; F02M 35/10242; F02M 35/161; F02M 35/14; F02M 31/20; F01P 1/00; F01P 1/06; F01P 11/00

USPC ..... 123/41.29, 41.31, 41.56, 198 E; 165/51, 165/164

See application file for complete search history.

(56) References Cited

U.S. PATENT DOCUMENTS

| | | | | |
|---|---|---|---|---|
| 4,548,166 A | | 10/1985 | Gest | |
| 5,092,284 A | * | 3/1992 | Yamada | F02B 27/06 123/184.55 |
| 5,320,190 A | | 6/1994 | Naumann et al. | |
| 5,660,243 A | | 8/1997 | Anzalone et al. | |
| 5,769,045 A | | 6/1998 | Edwards et al. | |

(Continued)

FOREIGN PATENT DOCUMENTS

| | | | | |
|---|---|---|---|---|
| DE | 102008038373 | * | 5/2009 | F01P 1/06 |
| JP | DE 102005058441 | * | 6/2006 | B60K 13/02 |

OTHER PUBLICATIONS

Machine translation of Detailed Description, DE102005058441A1, Hirose, Jun. 14, 2006, obtained from https://www.epo.org/index.html, pp. 1-9.*

*Primary Examiner* — Grant Moubry

(74) *Attorney, Agent, or Firm* — Ralph E. Smith

(57) ABSTRACT

An air intake assembly arranged in an engine compartment of an automotive vehicle and configured for directing air into a throttle body of an engine of the vehicle is provided. The air intake assembly includes an air intake duct and an air jacket. The air intake duct is configured to direct air from an inlet duct to the throttle body. The air jacket is arranged around the air intake duct. The air jacket has a first air jacket opening and a second air jacket opening. The air jacket forms an air gap between the air jacket and the air intake duct. Air flowing through the air jacket from one of the first and second air jacket openings to the other of the first and second air jacket openings cools the air intake duct thereby reducing a temperature of air directed from the intake duct into the throttle body.

15 Claims, 2 Drawing Sheets

(56) References Cited

U.S. PATENT DOCUMENTS

| | | | | |
|---|---|---|---|---|
| 5,806,480 | A * | 9/1998 | Maeda | F02M 35/10019 123/184.57 |
| 6,726,738 | B1 * | 4/2004 | Walker, Jr. | B01D 46/0086 123/198 E |
| 6,804,360 | B1 | 10/2004 | Misawa et al. | |
| 7,281,511 | B2 | 10/2007 | Quezada | |
| 7,424,880 | B2 * | 9/2008 | Awata | B60K 13/02 123/184.57 |
| 7,523,798 | B2 | 4/2009 | Muramatsu et al. | |
| 8,419,834 | B2 * | 4/2013 | Rotter | B01D 46/0004 123/198 E |
| 8,801,819 | B2 * | 8/2014 | Rotter | B01D 46/0004 123/198 E |
| 2005/0076871 | A1 | 4/2005 | Paek | |
| 2011/0240396 | A1 * | 10/2011 | Shiina | B62K 5/01 180/309 |

* cited by examiner

COLD AIR INTAKE CIRCULATING AIR JACKET

FIELD

The present application relates generally to air intake systems of motor vehicles and, more particularly, to a circulating air jacket arranged relative to the air intake system of a motor vehicle.

BACKGROUND

Air intake assemblies are provided on automotive motor vehicles to deliver intake air to an intake manifold of an internal combustion engine. The air intake assembly is arranged in an engine compartment of the automotive vehicle. The air intake assembly typically includes an air cleaner enclosure unit and an air intake duct. In one common arrangement, intake air flows from the air cleaner enclosure unit, through the intake duct and into the intake manifold.

In general, the engine compartment can get hot in temperature due to the operational temperatures of the various components housed in the engine compartment, including the internal combustion engine. As a result, the intake air can be undesirably warmed as it passes through the air cleaner enclosure unit and the air intake duct. As the temperature of the intake air increases, a reduction in engine power occurs. Thus, while cold air intake systems work for their intended purpose, there remains a need for improvement in the relevant art.

SUMMARY

In one aspect, an air intake assembly arranged in an engine compartment of an automotive vehicle and configured for directing air into a throttle body of an engine of the vehicle is provided. In one exemplary implementation, the air intake assembly includes an air intake duct and an air jacket. The air intake duct is configured to direct air from an inlet duct to the throttle body. The air jacket is arranged around the air intake duct. The air jacket has a first air jacket opening and a second air jacket opening. The air jacket forms an air gap between the air jacket and the air intake duct. Air flowing through the air jacket from one of the first and second air jacket openings to the other of the first and second air jacket openings cools the air intake duct thereby reducing the temperature of the air directed from the intake duct into the throttle body.

According to additional features, the air intake assembly further includes an air cleaner enclosure unit. The air jacket is further arranged around the air cleaner enclosure unit. Air flowing through the air jacket from one of the first and second air jacket openings to the other of the first and second air jacket openings cools the air cleaner enclosure unit thereby reducing a temperature of air directed into the throttle body.

According to still other features, air flows through the air jacket upon a pressure drop between the first and second air jacket openings. The first air jacket opening can be arranged at a first location in the engine compartment. The second air jacket opening can be arranged at a second location in the engine compartment. Air flows through the air jacket from an area of high pressure at one of the first and second openings to an area of low pressure at the other of the first and second openings. In one exemplary configuration, the first location is proximate a vehicle wheelhouse. In one exemplary configuration, the second location is proximate to a vehicle radiator. In one exemplary arrangement, air flows into the first opening at the first location and out of the air jacket at the second opening at the second location during idle operation of the internal combustion engine. In another arrangement, air flows into the second opening at the second location and out of the air jacket at the first opening at the first location during movement of the automotive vehicle.

In another aspect, an air intake assembly arranged in an engine compartment of an automotive vehicle includes an air cleaner enclosure unit, an air intake duct and an air jacket. The air intake assembly is configured to direct air into a throttle body of an internal combustion engine of the automotive vehicle. The air cleaner enclosure unit has an air cleaner intake tube and an air cleaner outlet tube. The air intake duct is fluidly connected between and configured to direct air from the air cleaner outlet tube to the throttle body. The air jacket is arranged around the air cleaner enclosure unit and the air intake duct. The air jacket has a first air jacket opening and a second air jacket opening. The air jacket forms an air gap between (i) the air jacket, and (ii) the air cleaner enclosure and the air intake duct. Air flowing through the air jacket from one of the first and second air jacket openings to the other of the first and second air jacket openings cools the air cleaner enclosure and the air intake duct thereby reducing a temperature of air directed from the intake duct into the throttle body.

According to additional features, air flows through the air jacket upon a pressure drop between the first and second air jacket openings. The first air jacket opening can be arranged at a first location in the engine compartment. The second air jacket opening can be arranged at a second location in the engine compartment. Air flows through the air jacket from an area of high pressure at one of the first and second openings to an area of low pressure at the other of the first and second openings. In one exemplary configuration, the first location is proximate a vehicle wheelhouse. In one exemplary configuration, the second location is proximate to a vehicle radiator. In one exemplary arrangement, air flows into the first opening at the first location and out of the air jacket at the second opening at the second location during idle operation of the internal combustion engine. In another exemplary arrangement, air flows into the second opening at the second location and out of the air jacket at the first opening at the first location during movement of the automotive vehicle.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings referenced therein, are merely exemplary in nature intended for purposes of illustration only and are not intended to limit the scope of the present disclosure, its application or uses. Thus, variations that do not depart from the gist of the present disclosure are intended to be within the scope of the present disclosure.

DESCRIPTION

Figure 1:
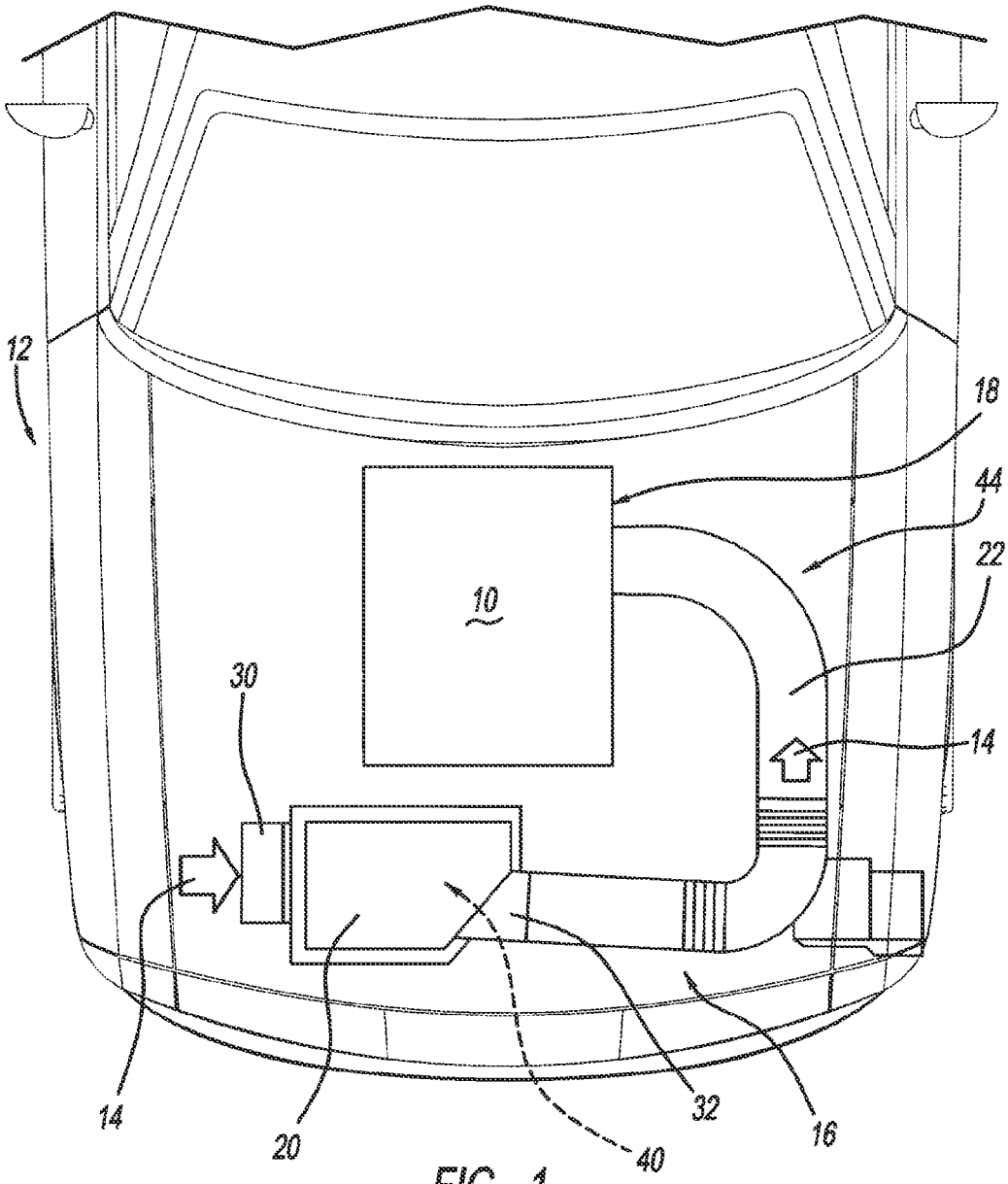
FIG - 1 Prior Art
FIG. 1 is a top view of a schematic illustration of an air intake assembly directing air into an internal combustion engine according to one example of prior art.
Figure 2:
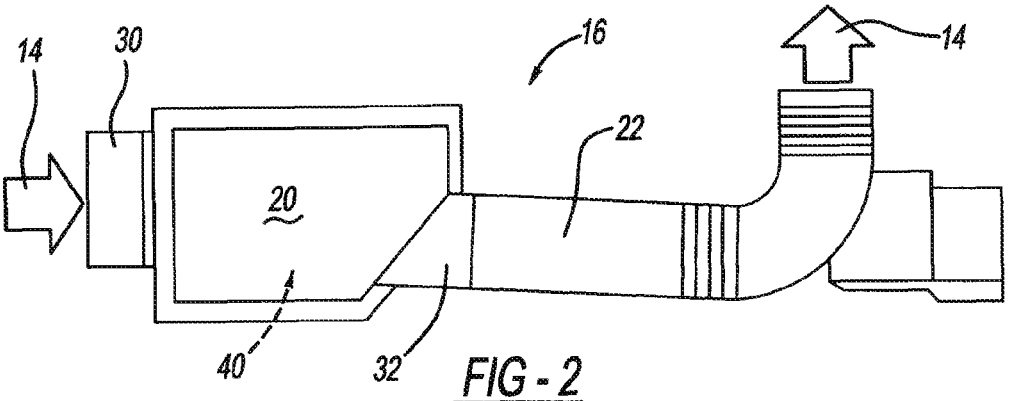
FIG - 2 Prior Art
FIG. 2 is a top view of the air intake assembly of FIG. 1.

With initial reference to FIGS. 1 and 2, an internal combustion engine 10 for powering an automotive vehicle 12 according to one prior art example is shown. Intake air 14 is directed through an air intake assembly 16 and into a throttle body 18 of the internal combustion engine 10. The air intake assembly 16 includes an air cleaner enclosure unit 20 and an air intake duct 22. The air cleaner enclosure unit 20 further includes an engine air cleaner intake tube 30 and an engine air cleaner outlet tube 32.

The air cleaner enclosure unit 20 includes a housing 36 that supports an air filter 40. Air entering the intake tube 30 passes through the air filter 40 and exits the air cleaner enclosure unit 20 at the engine air cleaner outlet tube 32. From the engine air cleaner outlet tube 32, the inlet air is directed through the air intake duct 22 and into the throttle body 18 of the internal combustion engine 10. The air intake assembly 16 is arranged in an engine compartment 44 of the automotive vehicle 12. In general, the engine compartment 44 can get hot in temperature from radiative, convective and conducting heat sources. As a result, the intake air 14 is warmed as it passes through the air cleaner enclosure unit and the air intake duct 22. As the temperature of the intake air 14 increases, the loss of engine power also increases. As will become more appreciated from the following discussion, the present disclosure provides an improved air intake assembly that delivers cooler air into the throttle body 18.

Figure 3:
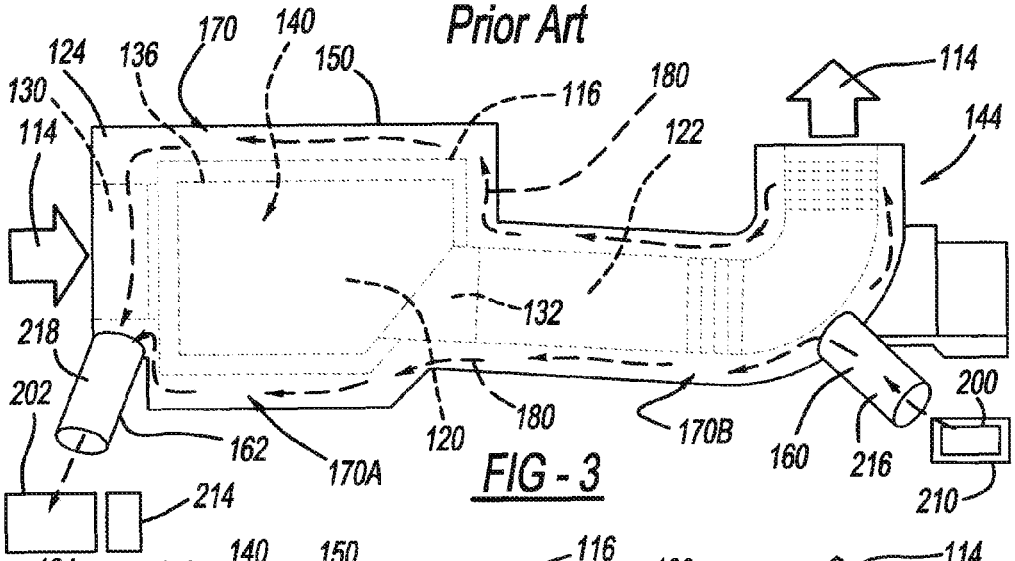
FIG. 3 is a schematic illustration of an air intake assembly constructed in accordance to one example of the present disclosure.
Figure 4:
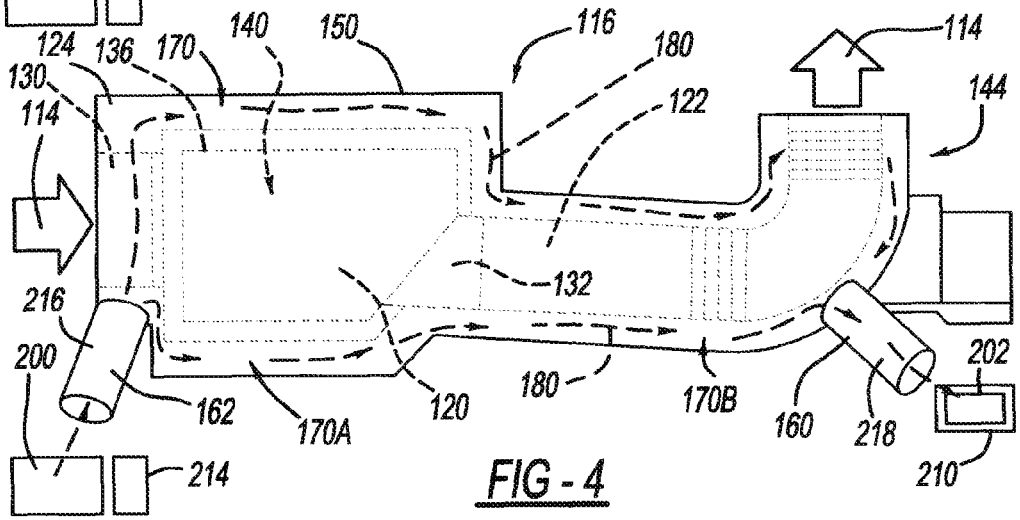
FIG. 4 is a schematic illustration of an air intake assembly constructed in accordance to another example of the present disclosure.

With reference now to FIGS. 3 and 4, an air intake assembly configured for directing air into a throttle body of an internal combustion engine is shown and generally identified at reference numeral 116. The air intake assembly 116 includes an air cleaner enclosure unit 120, an air intake duct 122 and an air jacket 124. The air jacket 124 is arranged generally around the air cleaner enclosure unit 120 and air intake duct 122 and is configured to circulate cool air between the air jacket 124 and the air intake assembly 116.

The air cleaner enclosure unit 120 further includes an air cleaner intake tube 130 and an engine air cleaner outlet tube 132. The air cleaner enclosure unit 120 includes a housing 136 that supports an air filter 140. Intake air 114 entering the intake tube 130 passes through the air filter 140 and exits the air cleaner enclosure unit 120 at the engine air cleaner outlet tube 132. From the engine air cleaner outlet tube 132, the intake air 114 is directed through the air intake duct 122 and into the throttle body of the internal combustion engine (see FIG. 1). The air intake assembly 116 is arranged in an engine compartment 144 of the automotive vehicle.

The air jacket 124 will now be further described. The air jacket 124 generally includes a jacket body 150 that is arranged around the air cleaner enclosure unit 120 and the air intake duct 122. The jacket body can be formed of rigid lightweight material such as plastic. The air jacket 124 has a first air jacket opening 160 and a second air jacket opening 162. As will become appreciated herein, depending on operating conditions of the vehicle, the first air jacket opening 160 can act as an air jacket air inlet where air enters the air jacket 124 or as an air jacket air outlet where air exits the air jacket 124. The jacket body 150 of the air jacket 124 forms an air gap 170 between the jacket body 150 and the air intake assembly 116. Explained more fully, the jacket body 150 forms an air gap 170A between the jacket body 150 and the air cleaner enclosure 120 and an air gap 170B between the jacket body 150 and the air intake duct 122.

During operation, when a pressure drop is realized between the first and second openings 160 and 162 of the air jacket 124, fresh air 180 flows through the air gap 170 between the air jacket 124 and the air intake assembly 116 ultimately cooling the air intake assembly 116 and the engine intake air 114. In the example shown in FIG. 3, the first opening 160 is arranged proximate to a relatively high pressure source 200 while the second opening 162 is arranged proximate to a relatively low pressure source 202. In one configuration, the first opening 160 can be arranged at a wheelhouse or wheel well 210 and the second opening 162 can be arranged at a suction source such as a cooling fan shroud adjacent a radiator 214. In the example shown in FIG. 3, the first opening 160 acts as a cool air inlet 216. The second opening 162 acts as a cool air outlet 218. Other configurations are contemplated.

In the configuration shown in FIG. 4, the first opening 160 is arranged proximate to the relatively low pressure source 202 and the second opening 162 is arranged proximate to the relatively high pressure source 200. The first opening 160 acts as a cool air outlet 218. The second opening 162 acts as a cool air inlet 216. It will be appreciated that the locations of the high and low pressures 200 and 202 may change based on operating conditions of the vehicle. For example, while at idle, the low pressure source 202 may be located as shown in FIG. 3. In one example, a vehicle fan may be running but no air pressure coming in through the vehicle grill. The vehicle fan can therefore create suction in front of it drawing air out of the second opening 162.

In another exemplary driving condition, the vehicle may be travelling down the road where air pressure is coming in through the vehicle grill creating the situation shown in FIG. 4 where cooling air 180 enters the second opening 162 and exits the first opening 160. Other configurations are contemplated. It will be appreciated that is does not matter what direction the cooling air 180 is flowing through the air jacket 124 as it will cool the air intake assembly 116 regardless of direction. As long as a pressure differential exits between the first opening 160 and the second opening 162, the cooling air 180 will flow or circulate through the air jacket 124 causing the air intake assembly 116 to be cooled and ultimately the intake air 114 to be cooled.

It should be understood that the mixing and matching of features, elements, methodologies and/or functions between various examples may be expressly contemplated herein so that one skilled in the art would appreciate from the present teachings that features, elements and/or functions of one example may be incorporated into another example as appropriate, unless described otherwise above.

What is claimed is:

1. An air intake assembly arranged in an engine compartment of an automotive vehicle and configured for directing air into a throttle body of an engine of the automotive vehicle, the air intake assembly comprising:

an air cleaner enclosure unit having a housing configured to support an air filter;

an air intake duct configured to direct air from the air cleaner enclosure unit into the throttle body; and an air jacket arranged around the housing of the air cleaner enclosure unit and the air intake duct, the air jacket having a first air jacket opening and a second air jacket opening, the air jacket forming a first air gap between the air jacket and the housing of the air cleaner enclosure unit and a second air gap between the air jacket and the air intake duct;

wherein air flowing through the air jacket from one of the first and second air jacket openings to the other of the first and second air jacket openings cools the air cleaner enclosure unit and the air intake duct thereby reducing a temperature of air directed from the intake duct into the throttle body.

2. The air intake assembly of claim 1 wherein air flows through the air jacket upon a pressure drop between the first and second air jacket openings.

3. The air intake assembly of claim 2 wherein the first air jacket opening is arranged at a first location in the engine compartment and the second air jacket opening is arranged at a second location in the engine compartment.

4. The air intake assembly of claim 3 wherein air flows through the air jacket from an area of high pressure at one of the first and second openings to an area of low pressure at the other of the first and second openings.

5. The air intake assembly of claim 4 wherein the first location is proximate a vehicle wheelhouse.

6. The air intake assembly of claim 5 wherein the second location is proximate a vehicle radiator.

7. The air intake assembly of claim 6 wherein air flows into the first opening at the first location and out of the air jacket at the second opening at the second location during idle operation of the engine.

8. The air intake assembly of claim 7 wherein air flows into the second opening at the second location and out of the air jacket at the first opening at the first location during movement of the automotive vehicle.

9. An air intake assembly arranged in an engine compartment of an automotive vehicle and configured for directing air into a throttle body of an engine of the automotive vehicle, the air intake assembly comprising:

an air cleaner enclosure unit having an air cleaner intake tube and an air cleaner outlet tube;

an air intake duct fluidly connected between and configured to direct air from the air cleaner outlet tube to the throttle body; and an air jacket arranged around the air cleaner enclosure unit and the air intake duct, the air jacket having a first air jacket opening and a second air jacket opening, the air jacket forming a first air gap between the air jacket and the air cleaner enclosure unit, and a second air gap between the air jacket and the air intake duct;

wherein air flowing through the air jacket from one of the first and second air jacket openings to the other of the first and second air jacket openings cools the air cleaner enclosure and the air intake duct thereby reducing a temperature of air directed from the intake duct into the throttle body.

10. The air intake assembly of claim 9 wherein air flows through the air jacket upon a pressure drop between the first and second air jacket openings.

11. The air intake assembly of claim 10 wherein the first air jacket opening is arranged at a first location in the engine compartment and the second air jacket opening is arranged at a second location in the engine compartment.

12. The air intake assembly of claim 11 wherein air flows through the air jacket from an area of high pressure at one of the first and second openings to an area of low pressure at the other of the first and second openings.

13. The air intake assembly of claim 12 wherein the first location is proximate a vehicle wheelhouse.

14. The air intake assembly of claim 13 wherein the second location is proximate a vehicle radiator.

15. The air intake assembly of claim 14 wherein air flows into the first opening at the first location and out of the air jacket at the second opening at the second location during idle operation of the engine.

* * * * *